United States Patent [19]

Stoll et al.

[11] Patent Number: 4,762,270

[45] Date of Patent: Aug. 9, 1988

[54] SNAP OPEN TOTE CONTAINER ASSEMBLY

[75] Inventors: Mark S. Stoll, Deephaven; Glenn H. Brodin; LeRoy Miller, both of Minneapolis, all of Minn.

[73] Assignee: Liberty Diversified Industries, New Hope, Minn.

[21] Appl. No.: 41,927

[22] Filed: Apr. 24, 1987

[51] Int. Cl.[4] ..... B65D 5/32

[52] U.S. Cl. ..... 229/23 A; 150/51; 229/41 R; 229/52 AM; 229/52 AW; 229/DIG. 5; 229/DIG. 2

[58] Field of Search ..... 229/23 A, 23 AB, 23 R, 229/49, DIG. 5, DIG. 2, 41 R, 41 B, 52 AW, 52 AM; 150/49, 51

[56] References Cited

U.S. PATENT DOCUMENTS

| | | | |
|---|---|---|---|
| 119,806 | 10/1871 | Weston | 229/23 A |
| 130,963 | 8/1872 | Weston | 229/23 AB |
| 1,666,333 | 4/1928 | Isoyama | 229/41 R |
| 2,007,997 | 7/1935 | Beulke et al. | 150/51 |
| 2,600,439 | 6/1952 | Sloane | 150/49 |
| 2,778,560 | 1/1957 | Pfeiffer | 229/41 R |
| 2,791,365 | 5/1957 | Cohen | 229/23 R |
| 2,794,587 | 6/1957 | Weiss | 229/DIG. 5 |
| 2,990,995 | 7/1961 | Wessel | 229/52 AW |
| 3,167,211 | 1/1965 | McCormick | 229/41 R |
| 3,669,339 | 6/1972 | Schilling | 229/23 A |
| 3,964,607 | 6/1976 | Wagner | 229/23 R |
| 4,535,929 | 8/1985 | Sherman et al. | 229/142 |

*Primary Examiner*—Stephen Marcus
*Assistant Examiner*—Gary E. Elkins
*Attorney, Agent, or Firm*—Moore & Hansen

[57] ABSTRACT

A tote container assembly having a pair of support panels, each support panel being formed from a corrugated plastic material and having a longitudinal grain. The support panels are positioned with their grains perpendicular to one another, and each panel is folded into a U-shape. The edges of the panels are fastened by sonic welds over a wire rim member which extends around the top peripheral edge of the tote container, and defines a pair of handgrips on opposing sides of the container. The corners of the rim member are curved to present stacking shoulders at the top corners of the container.

15 Claims, 2 Drawing Sheets

FIG. 1
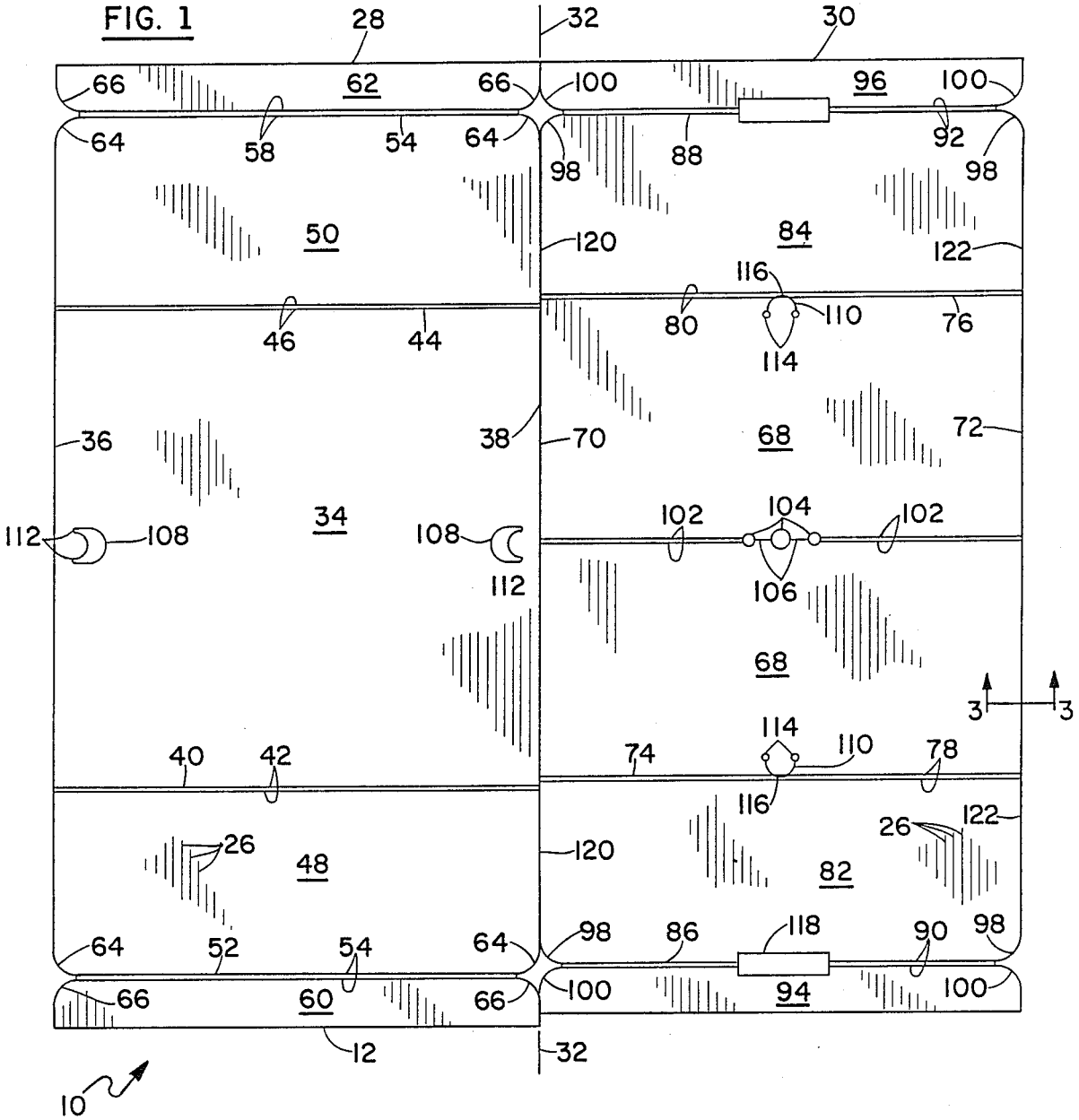
FIG. 2
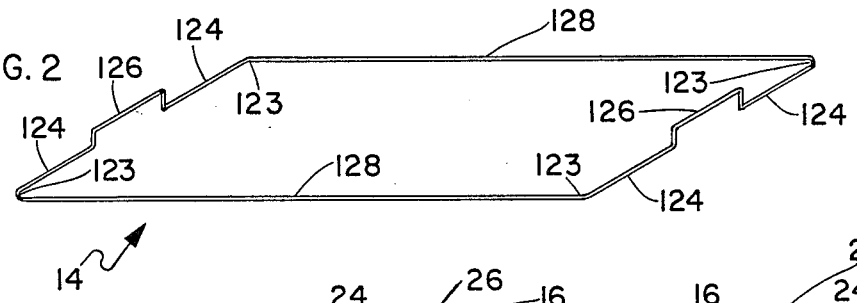
FIG. 3b
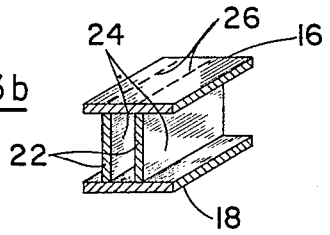
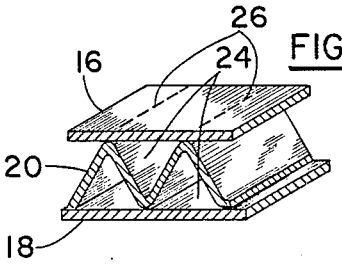
FIG. 3a

SNAP OPEN TOTE CONTAINER ASSEMBLY

BACKGROUND OF THE INVENTION

Cartons and tote containers formed from corrugated cardboard or fiberboard, wood, or plastic are well known. These containers generally have a horizontal rectangular bottom and four upright side walls. The side walls are usually either vertical, to define a substantially rectangular receptacle, or sloped, to form a tapering receptacle.

These tote containers may be formed in any variety of sizes, shapes, and constructions depending upon the particular applications for which they will be utilized, and the environment in which they will be used.

Beyond a simple receptacle for storing or transporting articles, such tote containers often include one or more additional features such as handles or cutout handgrip sections, stacking shoulders for stacking several like containers into a vertical column, removable or pivotable lids, ventilation apertures, liners, partitions, frame or structural reinforcing members, reinforced rims, and the like. The tote containers may also include additional panels other than the bottom, sides, and lid to increase the strength of the tote, provide greater structural integrity or durability, or to facilitate a particular method of assembly.

The requisites to fashioning such a tote container which will provide ever increasing utility and yet remain competitive in the marketplace with existing tote containers require the balancing of several competing factors. Because the tote containers are often mass produced and purchased in large quantities at a slight margin, the costs associated with manufacturing the totes must be kept to a minimum. This means that a minimal quantity of material must be used in forming each container, that the container blanks must be laid out in a pattern to reduce wasted materials, and that a limited number of machines and man-hours of labor be used in making and handling the totes.

The tote containers must provide the maximum in strength and durability for the particular application, sufficient in some instances so the tote containers may withstand repeated use and exposure to harsh treatment or conditions without damage, or be suited for disposable use in other situations.

Of those containers which are used repeatedly for a variety of applications in an assortment of different circumstances, one particularly desirable characteristic is the ability to fold the container into a small package for storage or shipping, and yet quickly and easily assemble the container to present a receptacle with maximal volume for use.

Existing tote containers each may have relative advantages over other comparable types of tote containers, depending upon the specific requirements of the application for which the tote container is best suited. The existing tote containers do present several common drawbacks or deficiencies.

In the majority of containers, the support panel is formed from a single ply of material cut from a unitary blank, folded, and then fastened together at a few points with glue or staples.

In those containers where a tensile fibre or other longitudinal reinforcement is employed to increase the strength or integrity of the container, the fibers or reinforcing materials provide limited support from only two opposing side walls of the container, and do not extend completely under the receptacle portion to support the entire bottom of the container.

The strength of these containers is often further lessened by the manner in which the handgrips are formed, the placement of seams and folds at stress points. The use of notches or projections which create weakened stress-bearing points, or the type of fasteners used.

Many of the existing tote containers are difficult to assemble, and once assembled cannot be disassembled, folded, or broken down for storage or shipping without destroying the container or severely impairing its structural integrity.

BRIEF SUMMARY OF THE INVENTION

It is therefore one object of this invention to design a tote container assembly which may be quickly and easily unfolded and assembled to a substantially upright, self-supporting position for use.

It is a related object of this invention to design the above tote container assembly such that it may be quickly and easily folded to a completely collapsed, flat position for storage and shipping.

It is another object of this invention to design the above tote assembly such that the container is comprised of two independent U-shaped support panels, each of which underlie and define a generally open top receptacle which may receive and contain a variety of articles, to provide a maximum of vertical support strength.

It is a further object of this invention to design the above tote container assembly such that it may be constructed from a corrugated plastic sheet material having a grain, and such that the grain of each of the U-shaped support panels will be perpendicular to the other when the container is unfolded to its substantially upright, open position to provide a maximum of lateral structural integrity.

It is a related object of this invention to design the above tote container assembly so that an article supported by the two U-shaped support panels will be supported by four longitudinally grained side walls, with the grain of the material in those side walls extending parallel to the direction of force exerted by the weight of the article within the receptacle.

Another object of this invention is to design the above tote container assembly such that it has two opposing handgrip regions, and further includes a wire rim member which may provide an exposed handgrip for lifting and carrying.

It is a related object of this invention to design the above tote container assembly such that the rim member serves as a means to secure the tote container in its substantially upright position, and additionally serves to secure the tote container assembly in a completely collapsed, flat folded position.

It is yet another related object of this invention to design the above tote container assembly such that the rim member may form a plurality of corner stacking shoulders permitting several like tote container assemblies to be stacked in a vertical column.

Briefly described, the tote container assembly of this invention consists of a pair of support panels, each being formed from a corrugated plastic sheet material and having a longitudinal grain. The support panels are situated such that the grains of the two panels are perpendicular to one another, with each panel being folded into a U-shape, whereby each panel extends completely and continuously under the receptacle portion of the container. The panels are fastened to a wire rim member which extends around the top peripheral edge of the tote container, and which further has a pair of opposing handgrips for lifting and carrying the container. The corners of the rim member are also curved to present stacking shoulders at the top corners of the container, so that several like containers may be stacked in a vertical column.

BRIEF DESCRIPTION OF THE DRAWINGS

FIG. 1 is top plan view of the corrugated plastic sheet material, cut and scored to form the blank from which the snap-open tote container assembly of this invention is constructed;

FIG. 2 is a perspective view of the wire rim used in constructing the tote container assembly of this invention;

FIG. 3*a* is a perspective view of the wavelike corrugated plastic material from which the tote container assembly may be constructed, taken through line 3—3 in FIG. 1;

FIG. 3*b* is a perspective view of the beam-like corrugated plastic material from which the tote container assembly may be constructed, taken through line 3—3 in FIG. 1;

DESCRIPTION OF THE PREFERRED EMBODIMENT

Figure 4:
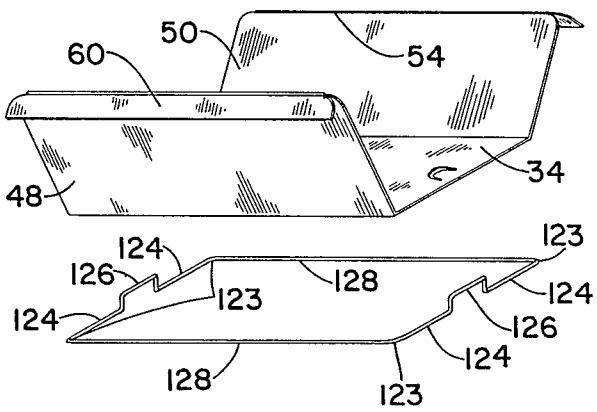
FIG. 4 is an exploded perspective view of the first support panel positioned above the rim member.

The snap-open tote container assembly of this invention is shown in FIGS. 1–9, and is referenced generally therein by the numeral 10.

The tote container assembly 10 is constructed from a sheet of corrugated plastic which is cut and scored to form a blank 12 as shown in FIG. 1, and a wire rim member 14 having the general shape of a rectangular hoop, as shown in FIG. 2.

Referring to FIG. 3*a*, the corrugated plastic sheet from which the blank 12 is cut and scored is composed of a pair of planar plies 16, 18 spaced a distance apart and encasing an intermediate convoluted ply 20 disposed between the planar plies 16, 18. The convoluted intermediate ply 20 may take the shape of a generally uniform sinusoidal wave which contacts and is adhered to the planar plies 16, 18 during the molding and corrugating process. In some applications, the convoluted intermediate ply 20 may take the form of several separated beam members 22 which are attached at each end thereof to the planar plies 16, 18, respectively, at generally perpendicular angles thereto, as shown in FIG. 3*b*.

In each case, the planar plies 16, 18 and the intermediate ply 20 or beam members 22 define a multiplicity of air pockets 24 which extend longitudinally through the sheet of material. These air pockets 24, along with the convolutions of the intermediate ply 20 or the beam members 22, define the grain of the sheet material, which may often be visible due to the natural translucence of the plastic used to form the plies 16, 18, 20 or to the slight rippling of the planar plies 16, 18 occurring along the lines 26 at which the intermediate ply 20 or beam members 22 are adhered to the planar plies 16, 18.

The blank 12 is divided by a cut line 32 extending longitudinally the length of the blank 12 to form first and second support panels 28, 30, respectively. The cut line 32 and the corresponding lengths of the support panels 28, 30 should be oriented substantially parallel to the grain 26 of the blank 12. The relative widths of the support panels 28, 30 may be equal to one another, or may vary depending upon the overall dimensions of the tote container 10 desired, as described below in further detail.

The first support panel 28 is further subdivided into a first base panel 34 having a pair of opposing end edges 36, 38 and a pair of opposing side edges 40, 42 defined by double scored fold lines 44, 46. A side wall panel 48, 50 extends longitudinally outward from and is hingedly connected to each of the side edges 40, 42 of the first base panel 34 along the double scored fold lines 44, 46. The outer edges 52, 54 of each side wall panel 48, 50 are defined by a similar double scored fold line 56, 58 respectively. A side wall flap 60, 62 extends longitudinally outward from and is hingedly connected to each of the outer edges 52, 54 of the side wall panels 48, 50 along the double scored fold lines 56, 58. The outer corners 64 of the side wall panels 48, 50 and the inner corners 66 of the side wall flaps 60, 62 should be rounded to a convex radius as described below.

The second support panel 30 is similarly subdivided into a second base panel 68 having a pair of opposing side edges 70, 72 and a pair of opposing end edges 74, 76 defined by double scored fold lines 78, 80. An end wall panel 82, 84 extends longitudinally outward from and is hingedly connected to each of the end edges 74, 76 of the second base panel 68 along the double scored fold lines 78, 80. The outer edges 86, 88 of each end wall panel 82, 84 are defined by a similar double scored fold line 90, 92 respectively. An end wall flap 94, 96 extends longitudinally outward from and is hingedly connected to each of the outer edges 86, 88 of the end wall panels 82, 84 along the double scored fold lines 90, 92. The outer corners 98 of the end wall panels 82, 84 and the inner corners 100 of the end wall flaps 94, 96 should be rounded to a convex radius as described below.

The second base panel 68 is further subdivided by an intermediate double scored fold line 102 and a plurality of circular apertures 104 connected by single cut lines 106. The center of the intermediate fold lines 102, single cut lines 106, and the centerpoints of the circular apertures 104 are spaced apart from a selected one of the end edges 74, 76 a distance equal to the distance between the end edges 74, 76 of the second base panel 68 and the outer edges 86, 88 of the end wall panels 82, 84.

A pair of half-moon shaped securing slots 108 cut entirely through the surface of the first base panel 34 are positioned adjacent to the opposing end edges 36, 38 and equidistant from the side edges 40, 42 of the first base panel 34. A pair of securing tabs 110 formed by semi-circular cut lines through the surface of the second base panel 68 are positioned adjacent to the end edges 74, 76 of the second base panel 68, equidistant from the side edges 70 and 72 of the second base panel 68, and may partially overlap the double scored fold lines 80. The outer points 112 of each slot 108 are rounded, and each end of the semi-circular aperture 114 extending through the surface of the blank 12.

The distance between each opposing slot 108 and each tab 110 should be approximately the same. Similarly, the distance between the outer points 112 of the slots 108 and the end edges 36, 38 of the first base panel 34 should be approximately the same as the distance between the terminal apertures 114 and the center 116 of the semi-circular cut line forming the tab 110.

Additionally, the relative widths of the first and second support panels 28, 30 as defined by the placement of the cut line 32 are determined by the length and width dimensions of the tote container assembly 10, which may vary according to the desired purpose and application of the particular tote container 10. In general, the length of both the tote container 10 and the first base panel 34 between the end edges 36 and 38 must be greater than the distance between the end edges 74, 76 of the second base panel 68 by two times the thickness of the corrugated plastic used to form the blank. The width of the second base panel 68 between the side edges 70 and 72 should be equal to the distance between the side edges 409 and 42 of the first base panel 34.

The second support panel also defines a pair of rectangular handgrip apertures 118, each aperture having a length generally greater than the width of the palm of an average sized hand, and a width generally greater than the thickness of the palm of an average sized hand. Each hand grip aperture 118 is positioned along the double scored fold lines 90, 92 between the end wall panels 82, 84 and the end wall flaps 94, 96, respectively, equidistant from each side edge 120, 122 of the end wall panels 82, 84, with each handgrip aperture 118 extending an equal distance widthwise into the end wall panels 82, 84 and end wall flaps 94, 96.

Referring to FIG. 2, the wire rim member 14 is bent from a heavy gauge rod of a metal such as steel or aluminum having a generally circular cross section, the free ends of the rod being fastened together by welding or other suitable means. The rim member 14 is bent to form a substantially rectangular hoop having a length equal to the length of the tote container assembly to and the first base panel 34, and a width equal to the width of the tote container assembly 10 and the first base panel 34. The corners 123 of the rim member 14 are rounded to a radius substantially equal to the radii of the corners 64, 66, 98, 100 of the side wall panels 48, 50, side wall flaps 60, 62, end wall panels 82, 84, and end wall flaps 94, 96, respectively.

Two opposing regions of the end sections 122 of the rim member 14 are bent upwardly to form a pair of inverted, generally rectangular, U-shaped handgrips 126, each handgrip 126 located on opposing ends of the rim member 14, with each handgrip 126 having a length less than the length of the handgrip apertures 118 in the second support panel 30, and being located equidistant from the side sections 128 of the rim member 14.

Figure 5:
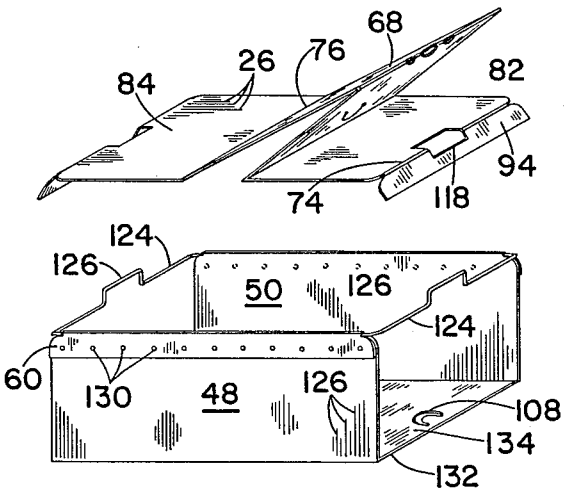
FIG. 5 is an exploded perspective view of the first support panel folded and assembled in the substantially upright position, with the second support panel oriented above the first support panel.

In operation, the method for assembling the tote container 10 may be illustrated particularly by reference to FIG. 5. The first support panel 28 is positioned such that the first base panel 34 is generally horizontal, thereby orienting an outer planar surface 132 of the first base panel 34 in the downward direction, and orienting an inner planar surface 134 of the first base panel 34 in a generally upward direction. Each side wall panel 48, 50 is folded upwardly across the double scored fold lines 42, 44 to a generally vertical position. The rim member 14, with the handgrips 126 extending in the upward direction, is then placed over the side wall panels 48, 50 and lowered to a position adjacent and parallel to the double scored fold lines 56, 58 along which the side wall flaps 60, 62 are connected. Alternately, the first support panel 28 may be received within the rim member 14 to the same position as described above. The side wall flaps 60, 62 are then folded outwardly and downwardly across the double scored fold lines 56, 58 to a position parallel to and in abutting contact with the outer surfaces of the side wall panels 48, 50, and are attached thereto by thermal welds 130 or other suitable fastening means to secure the first support panel 28 in a substantially upright position.

The second support panel 30 is positioned generally vertically above the first support panel 28 with the second base panel 68 folded upwardly across the intermediate fold lines 102 as shown in FIG. 5. Alternately, the second base panel 68 may be folded downwardly across the intermediate fold lines 102, although folding the second base panel 68 upwardly has proven more convenient in further assembling the tote container 10. The second support panel 30 may then be placed on top of the rim member 14 and the first support panel 28, with the upwardly projecting handgrips 126 of the rim member 14 being received within the handgrip apertures 118 of the second support panel 30. The end wall flaps 94, 96 are then folded downwardly around the end sections 124 of the rim member 14 and into abutting contact with the end wall panels 82, 84 of the second support panel 30. The end wall flaps are then fastened to the end wall panels 82, 84 using sonic welds 130 or other suitable fastening means.

Figure 6:
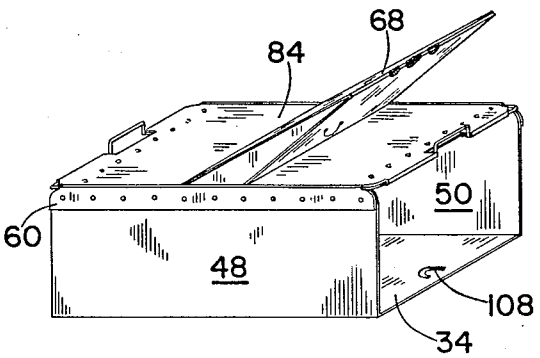
FIG. 6 is a perspective view of the tote container of FIG. 1 with the second support panel attached to the rim member.
Figure 8:
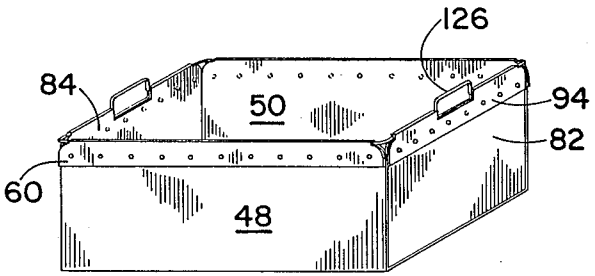
FIG. 8 is a perspective view of the tote container of FIG. 1 folded to the substantially upright, self-supporting position.
Figure 7:
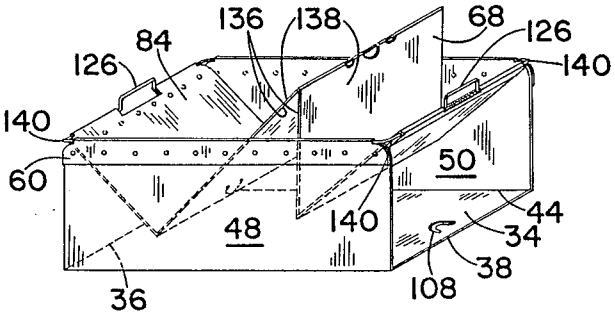
FIG. 7 is a perspective view of the second support panel being partially unfolded to the opened position.

In order to open the tote container assembly 10 to its self-supporting, upright position as shown in FIG. 8 from the semi-opened position shown in FIG. 6, each of the end wall panels 82, 84 of the second support panel 30 are pivoted downwardly and outwardly around the respective end sections 124 of the rim member 14 as shown in FIG. 7. As the end wall panels 82, 84 are pivoted downward, the second base panel 68 will pivot to an inverted, V-shaped intermediate position as shown in FIG. 7, and then gradually unfold until the outer planar surface 136 of the second base panel 68 is in parallel abutting contact with the inner planar surface 134 of the first base panel 34, and the inner planar surface 138 of the second base panel 68 is facing substantially in an upward direction, to form the substantially upright, self-supporting tote container assembly 10 shown in FIG. 8. The inner planar surface 138 of the second base panel 68, side wall panels 48, 50, and end wall panels 82, 84 thereby define an open top receptacle which may receive and support articles.

As the end wall panels 82, 84 are pivoted outwardly to a generally vertical position, the securing tabs 110 may be inserted into the securing slots 108. It has been observed that if the edges of the slots 108 and tabs 110 are beveled slightly, which may naturally occur due to the placement and orientation of the cuts made in the corrugated plastic used to form the blank 12, the tabs 110 will automatically be slidably received within the slots 108 as the second support panel 30 approaches its fully opened position wherein the outer planar surface 136 of the second base panel 68 is in parallel abutting contact with the inner planar surface 134 of the first base panel 34. Thus, no manual pressure must be exerted downwardly on the tabs 110 in order to ensure that the tabs 110 will be slidably received within the slots 10o8. In this manner, the tabs 110 will engage within the slots 108 to secure the tote container assembly 10 in the fully opened, substantially upright, self-supporting position.

It should be noted that in the fully opened, upright position, the grain in the plastic of the first support panel 28 is oriented substantially perpendicular to the grain in the plastic of the second support panel 30. Each panel 38, 30 extends completely under the receptacle portion of the tote container 10 and is attached along the substantial majority of the length of the edges 52, 54, 86, 88 to the rim member 14. The rim member 14 extends around the periphery of the open top of the receptacle defined by the tote container assembly 10. In forming the double scored fold lines 42, 44, 78, 80 which define the bottom peripheral edge of the tote container 10, the plastic sheet material in the blank 12 is not cut or punctured. Thus, the tote container assembly 10 will support an article within the receptacle portion with two complete panels of continuously reinforced corrugated plastic which extend entirely under the receptacle portion in two perpendicular directions. This orientation of the continuous, reinforced panels 28, 30 provides both vertical support, and lateral structural integrity. The rim member 14 serves to secure the side wall panels 48, 50 and the end wall panels 82, 84 in their upright positions, as well as attach the first support panel 28 to the second support panel 30 so that the panels will work in unison and the relative orientation of each panel 28, 30 is maintained.

Figure 9:
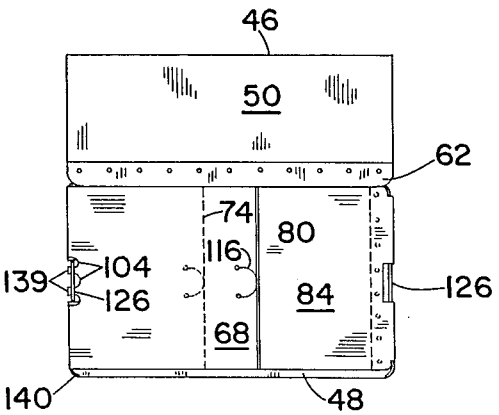
FIG. 9 ia a top view of the tote container of FIG. 1 folded to the completely collapsed configuration.

From the fully opened, upright position, the tote container assembly 10 may be folded to a completely collapsed, flat position as shown in FIG. 9 for storage or shipping. To fold the tote container assembly 10 to the completely collapsed configuration, a person may insert one or more fingers into the circular apertures 104 in the second base panel 68 and lift the second base panel 68 upward, folding it across the intermediate fold lines 102 through the intermediate position shown in FIG. 7 to the semi-opened position shown in FIG. 6. The side wall panels 48, 50 may then each be folded across the double scored fold lines 42, 44 in the same direction, such that the angle between one of the side wall panels 48, 50 and the first base panel 34 becomes acute and gradually decreases towards zero degrees, while the angle between the other of the side wall panels 48, 50 and the first base panel 34 becomes obtuse and generally increases towards one hundred eighty degrees. Once the side wall panels 48, 50 have been completely folded such that the second support panel 30 is substantially abutting and contacting one of the side wall panels 48, 50 and the first base panel 34, the exposed edges 139 of the second base panel 68 adjacent the cut lines 106 and between the circular apertures 104 may be engagingly received under the adjacent handgrip 126 of the rim member 14 as shown in FIG. 9.

From the fully collapsed, flat configuration, a person may quickly open the tote container assembly 10 by grasping the container assembly 10 with one's fingers at each handgrip 126, flexing the second support panel 30 by pressing inwardly on the exposed edges 139 of the second base panel 68 adjacent the cut lines 106 such that the exposed edges 139 disengage from the handgrips 126, and then pressing downwardly with one's thumbs on the end wall panels 82, 84. As the end wall panels 82, 84 pivot downward, in turn pivoting the side wall panels 48, 50 downward, the tote container assembly 10 snaps open into the generally upright position shown in FIG. 8 and previously described above.

Referring to FIG. 8, it should further be noted that the rounded radius of the corners 64, 66, 98, 100 of the side wall panels 48, 50, end wall panels 82, 84, side wall flaps 60, 62, and end wall flaps 94, 96 define an opening 140 adjacent each of the four corners. The corresponding curvature of the corners 123 of the rim member 14 permits a portion of each corner 123 of the rim member 14 to extend inwardly into the receptacle region relative to the otherwise square or right angle top corners of the upright tote container assembly 10, to form stacking shoulders upon which one or more like tote container assemblies 10 may be stacked in a vertical column.

While the preferred embodiment of the present invention has been described, it should be recognized that various changes, adaptations, and modifications may be made therein without departing from the spirit of the invention and scope of the appended claims.

What is claimed is:

1. A tote container assembly defining an open top receptacle region for receiving an article, said tote container assembly comprising:

a first support panel, said first support panel having a first base panel with two opposing side edges and two opposing end edges, and a pair of side wall panels, said side wall panels extending from said opposing side edges of said first base panel and hingedly connected thereto along scored side fold lines, said wall panels each being foldable across said scored side fold lines to an upright position generally perpendicular to said first base panel, said first base panel further having an inner planar surface and an outer planar surface opposing said inner surface;

a second support panel, said second support panel having a second base panel with two opposing side edges and two opposing end edges, and a pair of end wall panels, said end wall panels extending from said opposing end edges of said second base panel and hingedly connected thereto along scored end fold lines, said end wall lines to an upright position generally perpendicular to panels each being foldable across said scored end fold said second base panel, said second base panel having an intermediate scored fold line extending between said side edges thereof substantially perpendicular to said scored fold lines along which said end wall panels are connected thereto, said second base panel being foldable across said intermediate scored fold line, said second base panel further having an inner planar surface and an outer planar surface opposing said inner surface; and securing means mountable on said first support panel and said second support panel for securing said side wall panels and said end wall panels in said upright position, and for further connecting said first support panel to said second support panel such that said outer planar surface of said second base panel may be placed in parallel abutting contact with said inner planar surface of said first base panel to define the open top receptacle region when said side wall panels and said end wall panels are folded to said upright position, whereby the article may be removably received within said receptacle.

2. The tote container assembly of claim 1 wherein the first support panel has a first grain throughout and the second support panel has a second grain throughout, said first grain in the first base panel being oriented substantially perpendicular to said second grain in the second base panel when the tote container assembly is folded to the upright position.

3. The tote container assembly of claim 1 wherein the first base panel has a length and the second base panel has a width, and wherein the securing means is a generally rectangular rim member having a length dimension substantially equal to the length of the first base panel and a width dimension generally equal to the width of the second base panel.

4. The tote container assembly of claim 3 further comprising:

a pair of side wall flaps, each said side wall flap extending from and hingedly connected to an opposing one of the side wall panels along a scored fold line; and a pair of end wall flaps, each said end rim flap extending from and hingedly connected to an opposing one of the end wall panels along a scored fold line;

whereby each of the side wall flaps may be pivoted around the rim member and into parallel abutting contact with one of the side wall panels and fastened thereto with the rim member being received between the side wall panels and the side wall flaps, and each of the end wall flaps may be pivoted around the rim member and into parallel abutting contact with one of the end wall panels and fastened thereto with the rim member being received between the end wall panels and the end wall flaps.

5. The tote container assembly of claim 4 wherein each of the end wall panels and each of the end wall flaps define a handgrip aperture extending entirely through the surface thereof, each said handgrip aperture being adjacent to the scored fold line along which the end wall panels are hingedly connected to the end wall flaps, said handgrip apertures communicating to form a pair of handgrip openings when the tote container is folded to the upright position and the end wall flaps are fastened to the end wall panels.

6. The tote container assembly of claim 5 wherein the rim member further defines a pair of handgrips, each handgrip having at least a portion extending upwardly from the rim member when the tote container assembly is folded to its upright position, said handgrips being aligned with and extending through the handgrip openings.

7. The tote container assembly of claim 3 wherein the rim member is formed from a metal rod, said rod having two opposing free ends, said metal rod being bent and the opposing free ends being fastened together to form the rim member.

8. The tote container of claim 3 wherein the tote container further defines a top peripheral edge having four generally right angle top corners, and wherein the side wall panels, end wall panels, side wall flaps, and end wall flaps adjacent each said top corner define four openings extending therethrough, and further wherein sections of the rim member adjacent each said top corner are curved such that said sections of rim member extend through said openings and into the receptacle region, said sections of rim member forming stacking shoulders, whereby a like one of said tote container assemblies may be stacked in a vertical column on top of the stacking shoulder of the tote container assembly.

9. The tote container assembly of claim 1 wherein the first support panel and the second support panel are cut from a blank of corrugated plastic material.

10. The tote container assembly of claim 1 wherein the distance between the opposing side edges of the first base panel is greater than the distance between the opposing side edges of the second base panel.

11. The tote container assembly of claim 10 wherein the distance between the opposing end edges of the first base panel is substantially equal to the distance between the opposing end edges of the second base panel.

12. The tote container assembly of claim 1 wherein the second base panel may be folded across the intermediate fold line such that a first portion of the outer planar surface of the second base panel is in parallel abutting contact with a second portion of the outer surface of the second base panel, and further wherein the side wall panels of the first support panel may be folded across the fold lines along which the side wall panels are connected to the first base panel such that a portion of the planar surface of one of said side wall panels is in parallel abutting contact with a portion of the inner surface of the first base panel to fold the tote container assembly to a substantially collapsed configuration.

13. The tote container assembly of claim 12 wherein the second base panel further defines two or more apertures, said apertures being adjacent to and overlapping said intermediate fold line, said intermediate fold line forming at least one edge extending between said apertures when the second base panel is folded across the intermediate fold line, said edge being engagingly received by said securing means when the tote container assembly is folded to the substantially collapsed configuration.

14. The tote container assembly of claim 1 wherein the first base panel defines a pair of securing slots, said securing slots being positioned proximate to the end edges of the first base panel, and wherein the second base panel defines a pair of securing tabs, said securing tabs being positioned proximate to the end edges of the second base panel, said securing tabs further being aligned with said securing slots such that said securing tabs are slidingly received within said securing slots when the tote container assembly is folded to its upright position.

15. The tote container assembly of claim 13 further comprising at least one linear cut line extending entirely through the surface of said second base panel, each said cut line connecting one of said apertures to at least one other of said apertures, each said cut line extending generally coextensively with said intermediate fold line and said edge formed between said apertures.

* * * * *